US010984769B2

(12) United States Patent
Spriewald

(10) Patent No.: US 10,984,769 B2
(45) Date of Patent: Apr. 20, 2021

(54) REINFORCEMENT SYSTEM TO ALLEVIATE GUITAR NECK BREAKAGE

(71) Applicant: Daniel Ingolf Spriewald, Glendale, CA (US)

(72) Inventor: Daniel Ingolf Spriewald, Glendale, CA (US)

( * ) Notice: Subject to any disclaimer, the term of this patent is extended or adjusted under 35 U.S.C. 154(b) by 0 days.

(21) Appl. No.: 16/460,930

(22) Filed: Jul. 2, 2019

(65) Prior Publication Data

US 2021/0005172 A1 Jan. 7, 2021

(51) Int. Cl.
*G10G 5/00* (2006.01)

(52) U.S. Cl.
CPC ..... *G10G 5/00* (2013.01)

(58) Field of Classification Search
CPC ..... G10G 5/00
See application file for complete search history.

(56) References Cited

U.S. PATENT DOCUMENTS

| | | | |
|---|---|---|---|
| 4,084,476 | A | 4/1978 | Rickard |
| 4,915,004 | A | 4/1990 | Clough |
| 5,233,122 | A | 8/1993 | Kim |
| 5,249,498 | A | 10/1993 | Wilfer |
| 6,046,393 | A | 4/2000 | Rose |
| 6,051,765 | A | 4/2000 | Regenberg et al. |
| 6,664,453 | B2 | 12/2003 | Ito et al. |
| 6,888,055 | B2 | 5/2005 | Smith |
| 7,151,213 | B2 | 12/2006 | Hsieh |
| 7,189,907 | B1 | 3/2007 | Poulin |
| 7,297,851 | B2 | 11/2007 | Caldwell et al. |
| 7,462,767 | B1 | 12/2008 | Swift |
| 7,705,224 | B1 | 4/2010 | Ward |
| 8,273,974 | B1 | 9/2012 | Gonzalez |
| 8,558,096 | B2 | 10/2013 | Altheim |
| 8,835,730 | B2 | 9/2014 | Bagale |
| 8,937,236 | B2 | 1/2015 | Kunstadt |
| 9,761,208 | B1 | 9/2017 | Klick, Jr. |
| 9,899,011 | B2 | 2/2018 | Gallo et al. |
| 10,008,189 | B1 | 6/2018 | Baldemor |
| 2009/0139386 | A1* | 6/2009 | Kilpatrick ..... G10G 7/00 84/329 |

OTHER PUBLICATIONS

190305 Amazon—Mr Power Guitar Neck Rest.
190305 guitar neck reinforcement—Google Search.
190305 reinforcing guitar headstock—Google Search.
Guitar Neck Repairs_ Splines—Haze Guitars.
Headstock Repairs—More on Reinforcement—Haze Guitars.

* cited by examiner

*Primary Examiner* — Kimberly R Lockett
(74) *Attorney, Agent, or Firm* — The Soni Law Firm; Michael A. Long

(57) ABSTRACT

A system and method for guitar neck reinforcement during transit is disclosed with a head vise (100); a head vise bracket (102); an arm sleeve (104); an at least one padded cushion (106); a first arm sleeve hole (108); a second arm sleeve hole (110); a neck stay (112); a first neck stay hole (114); a second neck stay hole (116); an at least one arm (118); a neck saddle (120); a neck saddle pad (122); a neck saddle bracket (124); and a neck strap (126).

20 Claims, 11 Drawing Sheets

REINFORCEMENT SYSTEM TO ALLEVIATE GUITAR NECK BREAKAGE

BACKGROUND OF THE PRESENT INVENTION

1. Field of Invention

The present invention relates to musical instruments generally, in particular to guitar-like instruments having a neck and fretboard with tensioned strings, such as guitars, acoustic guitars whether steel-string or classical, electric guitars, guitar neck repair, and containers for guitars used when transporting a guitar.

2. Description of the Related Art

Guitar necks are prone to breaking in transit due to the pressure exerted on the head or headstock of the guitar and the weaker adjoining neck below the headstock. Such broken necks are common with acoustic guitars in particular, and other types of guitar instruments are also subject to neck breakage as well. Since guitars are made this way, the neck is a weak point and there is no known remedy for this problem other than to repair the neck after the fact, which results in a "Frankenstein" neck which must be rebuilt with significant repair effort. A guitar broken at the neck is never the same as it was before the damage.

Guitar cases vary in type and function and can generally be considered as a bag or hard case which is generally considered bulky, clunky, and not easily transported or favored by musicians who often travel to locations to perform at an event, rehearsal, recording, or otherwise perform. Gig bags are known in the related art. However, a gig bag is typically soft and does not provide resistance to prevent neck damage breakage.

It is known that tuning machines require resistance or tension to hold guitar strings in tune, thereby permitting accurate total resonance of each note played on the given string. Therefore, the guitar neck must maintain tension to sound musical notes. A guitar does not need string tension in order to be transported. It is known that loosening strings before transporting a guitar can be done. However, guitar necks with loosened strings can still be subject to breakage at the neck in particular. Guitar necks can break with or without strings while being transported. Guitar necks can break due to the angle of the neck in relation to the headstock.

Guitar stands are known in the related art. Guitars can break by falling off a guitar stand, particularly at the neck. However, conventional guitar stands are generally not designed to reinforce guitar necks against breakage.

Some guitar storage devices are hard cases. However, hard guitar cases are generally bulky, not ergonomic, and are not as easily transported since the hard case enclosure requires more space and is not ergonomically comfortable compared to an over-the-shoulder style gig bag.

Repair of broken guitar necks is also known in the related art. However, if a guitar is broken, it is too late. Repair is time consuming, and is generally unavailable or impractical at a performance venue or studio which typically lacks any repair capabilities. Repair of a broken guitar neck is typically done in a repair shop spanning days or weeks. Repair can provide attaching reinforcements after a guitar neck is broken with reinforcing portions behind and/or within the neck with adhesive to hold the broken pieces together. It is impractical to attempt to repair a broken guitar neck on site at the time the guitar—transported to a new location and breaking sometime before it is discovered to be broken—needs to be used.

An assortment of detachable or deconstructible reassembly guitars exist in the related art. However, detaching a guitar body and fretboard requires reassembly which can drastically affect playability. Reassembly requires more steps to achieve tuning and is impractical as measured by musical performance expectations when the instrument is to be used directly out of a gig bag with minimal tuning; reassembly-type instruments can be seen as requiring significant steps in addition to tuning which can be too much of a hassle and completely impractical for a musical performer.

Also known in the related art are neck-through-body or glue-on-neck guitars. Many guitars that break at the neck have a "neck-through-body" or "glue-on-neck" and cannot be detached without permanently damaging the guitar.

The head of the guitar typically holds tuning machines which wind strings into a specific tension that then is used to generate a given selected tone. Guitars can be rendered useless if broken at the neck since it can no longer hold strings in tune. It can be devastating for a musical performer who travels to a new location only to find their guitar now has a broken neck.

It can be seen then that a live or studio musician requires immediate use of a specific guitar instrument will need to avoid breakage to the neck of the guitar causing it not to be usable for a performance or recording. It can be seen that there is a need to reduce or eliminate the risk of breaking a guitar neck during storage for transit from one gig to another. It can be seen that there is a need to provide a convenient support without interfering with tuning functions of a guitar. It can be seen there is a need to prevent or minimize damage or breakage to the neck of a guitar instrument during transit. Therefore, it can also be seen that there is a need to solve any combination of the foregoing problems in the related art.

SUMMARY OF THE PRESENT INVENTION

Figure 1:
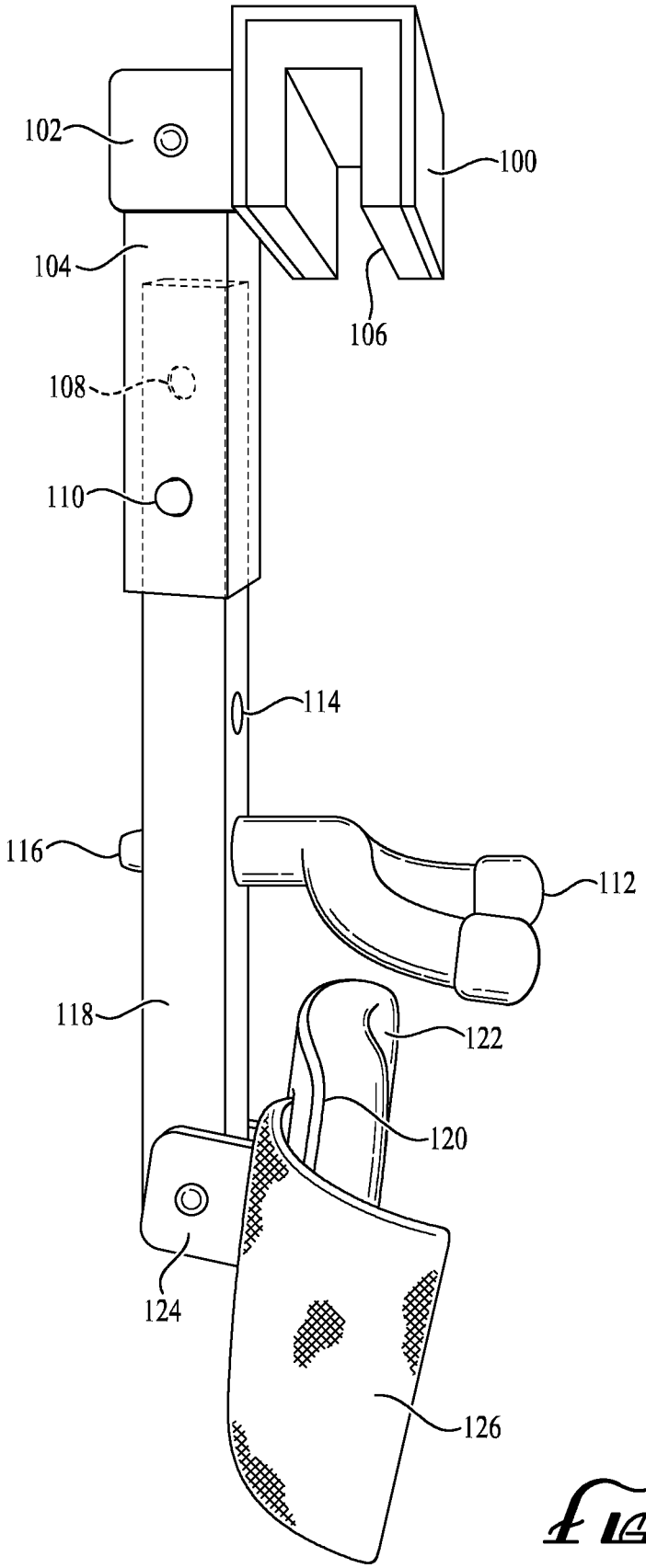
FIG. 1 is an overall side view of the present invention, without subject guitar.

To minimize the limitations in the prior art, and to minimize other limitations that will become apparent upon reading and understanding the present specification, the present invention discloses a method and system for guitar neck reinforcement during transit with a head vise; a head vise bracket; an arm sleeve; an at least one padded cushion; a first arm sleeve hole; a second arm sleeve hole; a neck stay; a first neck stay hole; a second neck stay hole; an at least one arm; a neck saddle; a neck saddle pad; a neck saddle bracket; and a neck strap.

The description of the preferred embodiments is to be understood as non-limiting examples of the present invention. The true scope of the invention is to be understood by the claims and not limited by the preferred embodiments.

An aspect of the present invention is to prevent broken guitar necks so they are usable at a new location for a live performance or recording session.

An aspect of the present invention is to provide a device capable of resisting, preventing, or minimizing strain or stress on a guitar neck particularly during transport or storage.

An aspect of the present invention is to provide an easy to use, lightweight and intuitive device capable of adjustment and capable of fitting guitar instruments or other fretted instruments of varying sizes and neck lengths.

An aspect of the present invention is to work with existing gig bags and guitars. Noting that as gig bags are comfortable and commonly used in industry, and while such gig bags do not provide neck reinforcement, it is possible to apply the teachings of the present invention to work with gig bags.

DETAILED DESCRIPTION OF THE DRAWINGS

In the following description of the preferred embodiments, reference is made to the accompanying drawings that form a part hereof, and in which is shown by way of illustration specific embodiments in which the invention may be practiced. It is to be understood that other embodiments may be utilized and structural changes may be made without departing from the scope of the present invention.

References throughout the specification to "a possible embodiment," "a preferred embodiment," "some embodiments," "an embodiment," and like reference to "embodiment" are non-limiting examples to aid in understanding the present invention. An "embodiment" provides that there is one or more embodiments that can involve the given element or aspect of the invention. Thus, multiple instances of "an embodiment" and like reference do not necessarily refer to the same embodiment.

The terms "guitar" or "subject guitar" or "guitar instrument" as used in the present specification are interchangeable and can refer to a wide range of fretboard instruments. Prominently known are steel-string and classical acoustic guitars. For purposes of this specification, "guitar" can include, by way of non-limiting illustration: acoustic guitar, steel-string guitar, archtop guitar, jazz guitar, resonator guitar, electric guitar, bass, violin, viola, cello, hollow body, solid body, very thin guitar, electric guitar, flamenco guitar, acoustic-electric guitar, electro-acoustic guitar, semi-acoustic guitar, classical guitar, tenor guitar, parlor guitar, bass, acoustic bass, electric bass, double bass, upright bass, mandolin, ukulele, banjo, fiddle, sitar, stick, fretted, fretless, midi-based, double-neck, or any n-numbered string instruments having similar neck, hybrid, string and fretboard against which strings can be held to sound notes, or any combination of the foregoing. A person having ordinary skill in the pertinent art would understand from the teachings of this specification how to apply the teachings of the present invention to a wide range of instruments with respect to the wide range of fretboard instruments including the foregoing described instruments, as well as any such variations that may exist now or future-developed.

It is known that instruments often have a unique configuration to which its owner is accustomed to using in its fine nuances, ranging from the touch and feel of the neck, frets, action of the strings over the frets, the familiarity of the instrument having been used over time, and the comfort and trademark or likeness that may be associated with a given musician and their guitar of choice. Instruments can carry sentimental value and while they break prolonging the life of an instrument can increase the value and reliability of the musician by enhancing the reliability with which guitars are transported.

The present invention can be applied to any number of forms of guitars or other fretted or unfretted stringed instruments having a neck and one or more tuned strings wherein the guitar head and tuning machines can adjust the precise tuning of a particular string. Tuning is typically measurable in tones or semitones and maintaining tuning is critically important to string-tuned instruments.

Figure 2:
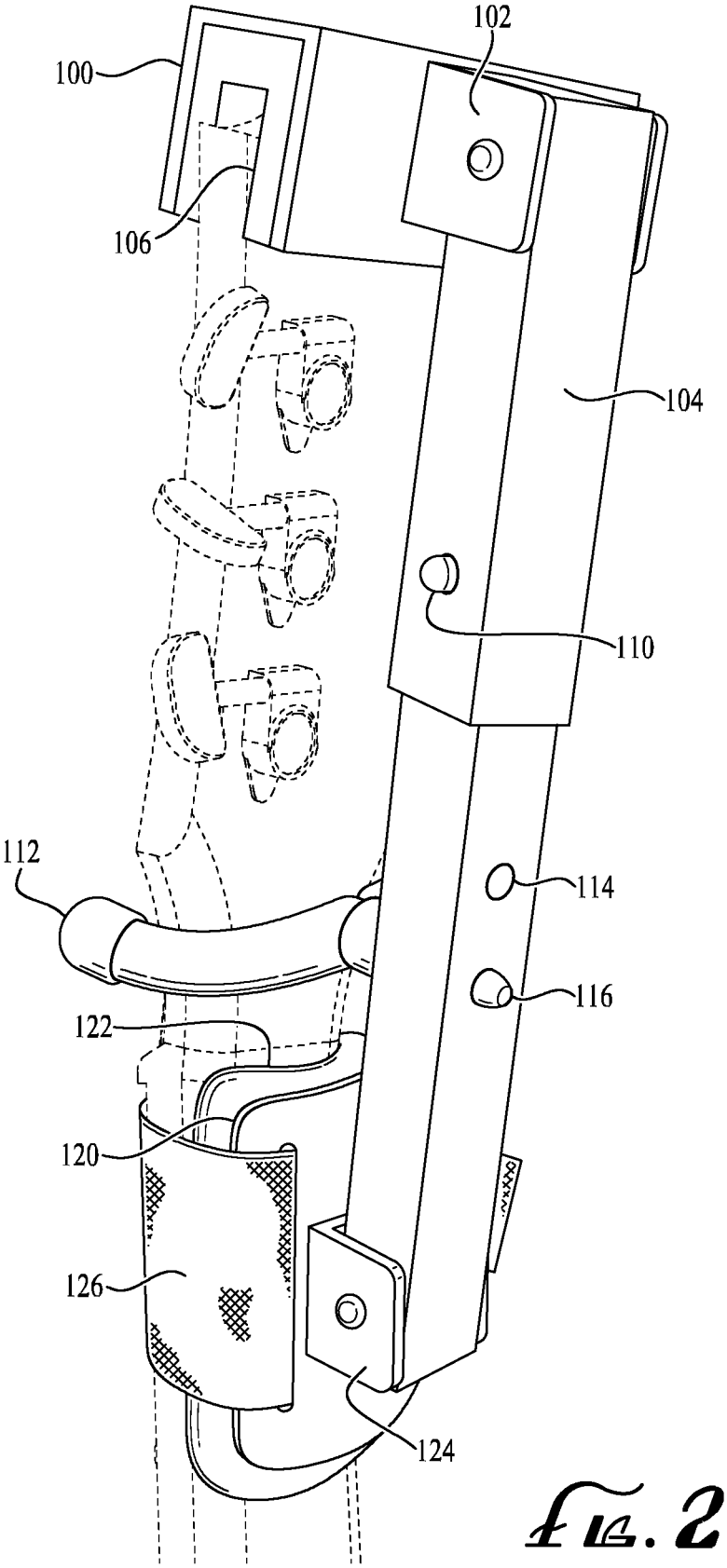
FIG. 2 is an angled rear side view of the present invention with subject guitar.
Figure 3:
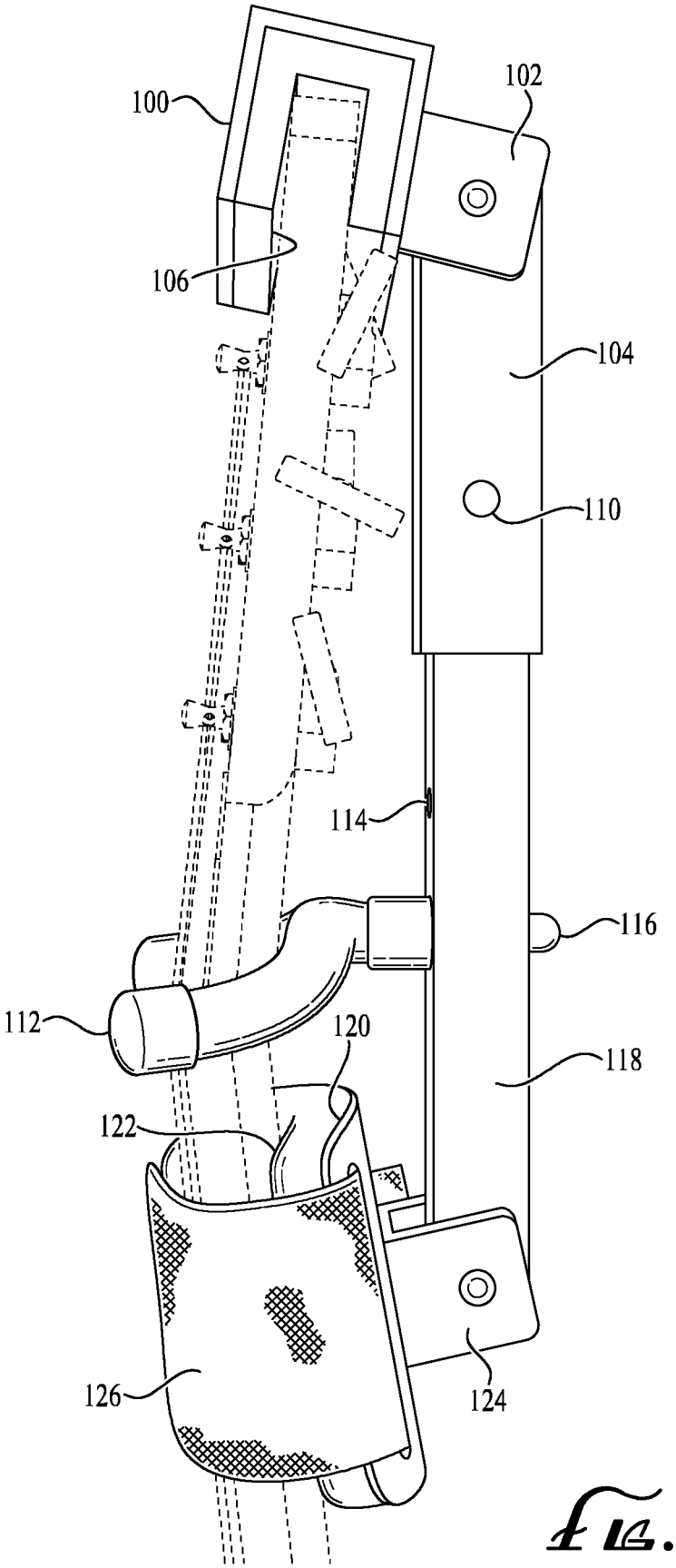
FIG. 3 is another side view of the present invention with subject guitar.
Figure 4:
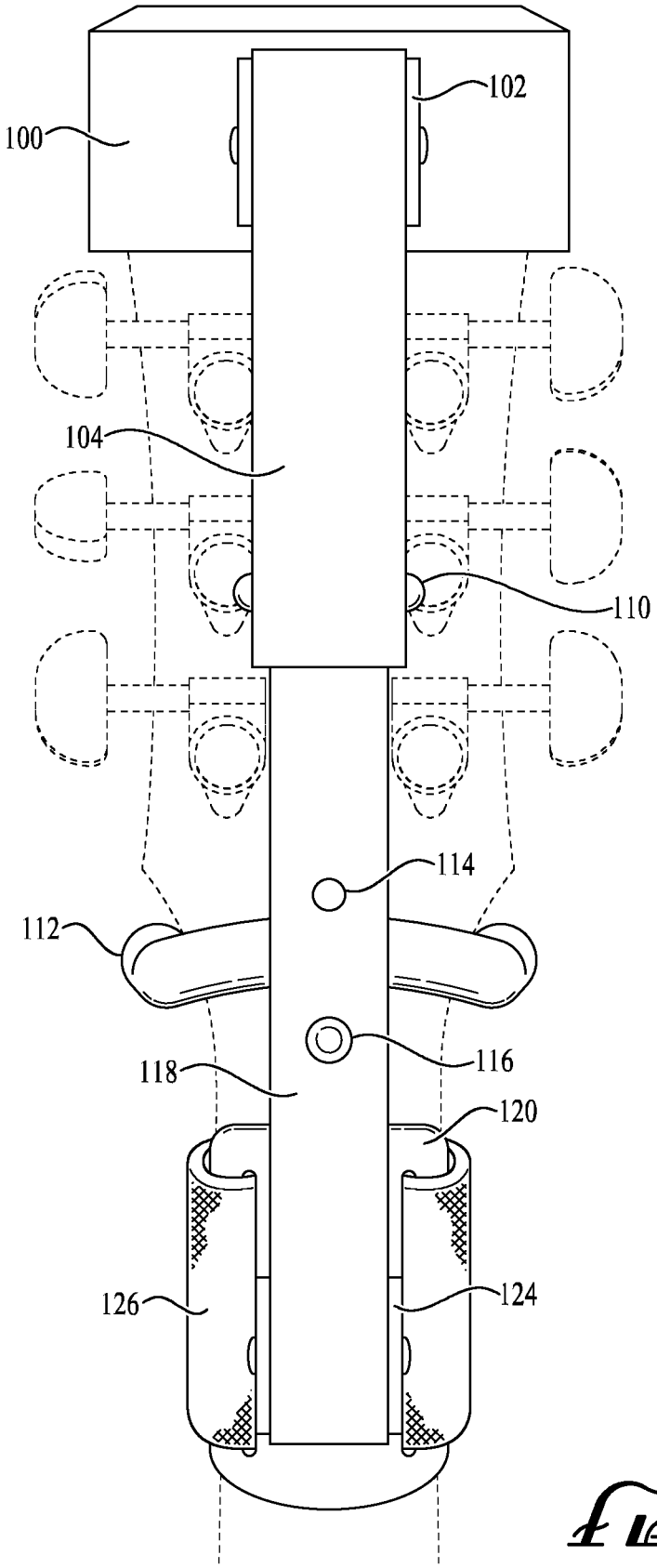
FIG. 4 is a back view of the present invention with subject guitar.
Figure 5:
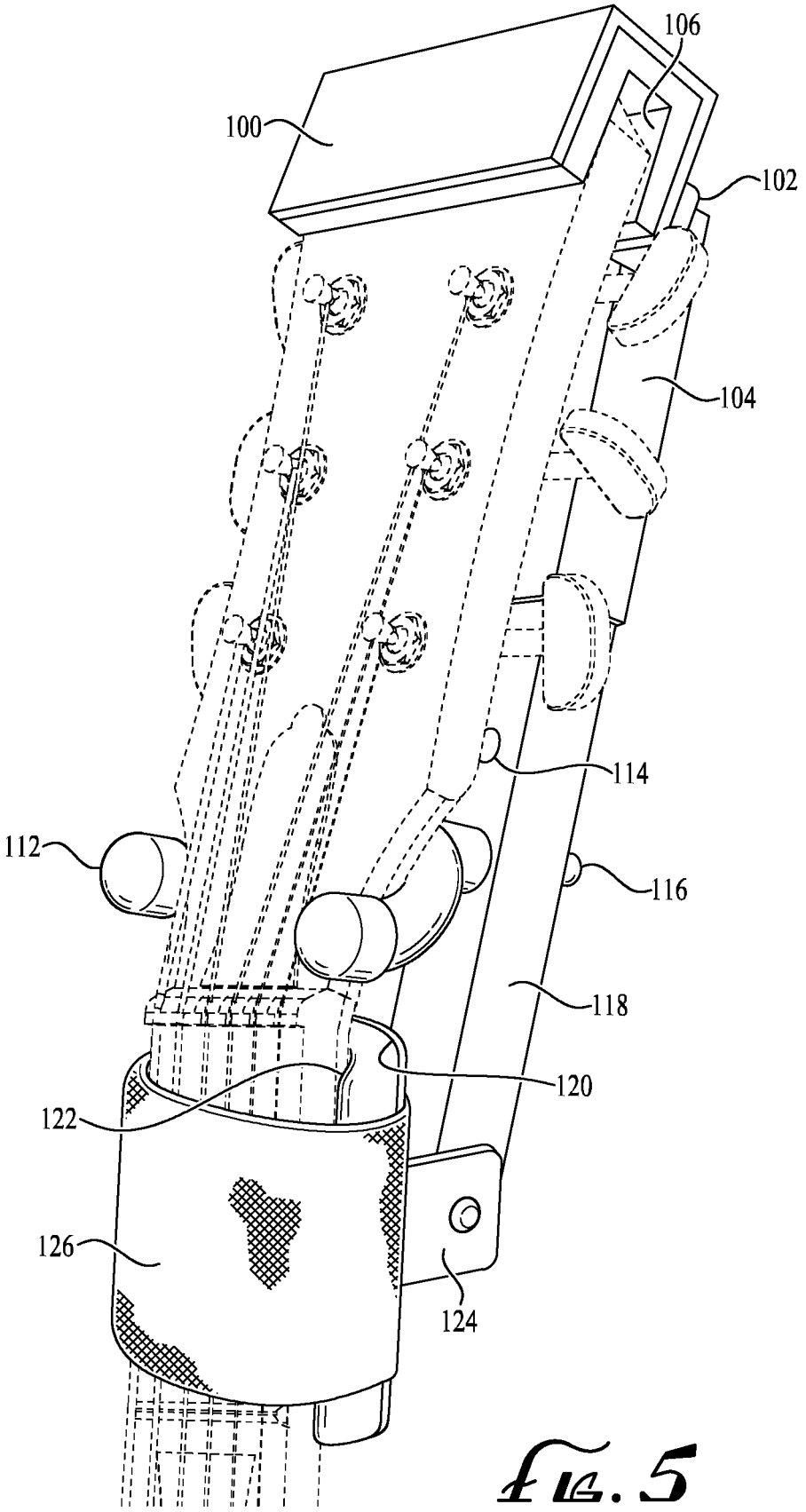
FIG. 5 is an angled front view of the present invention with subject guitar.
Figure 6:
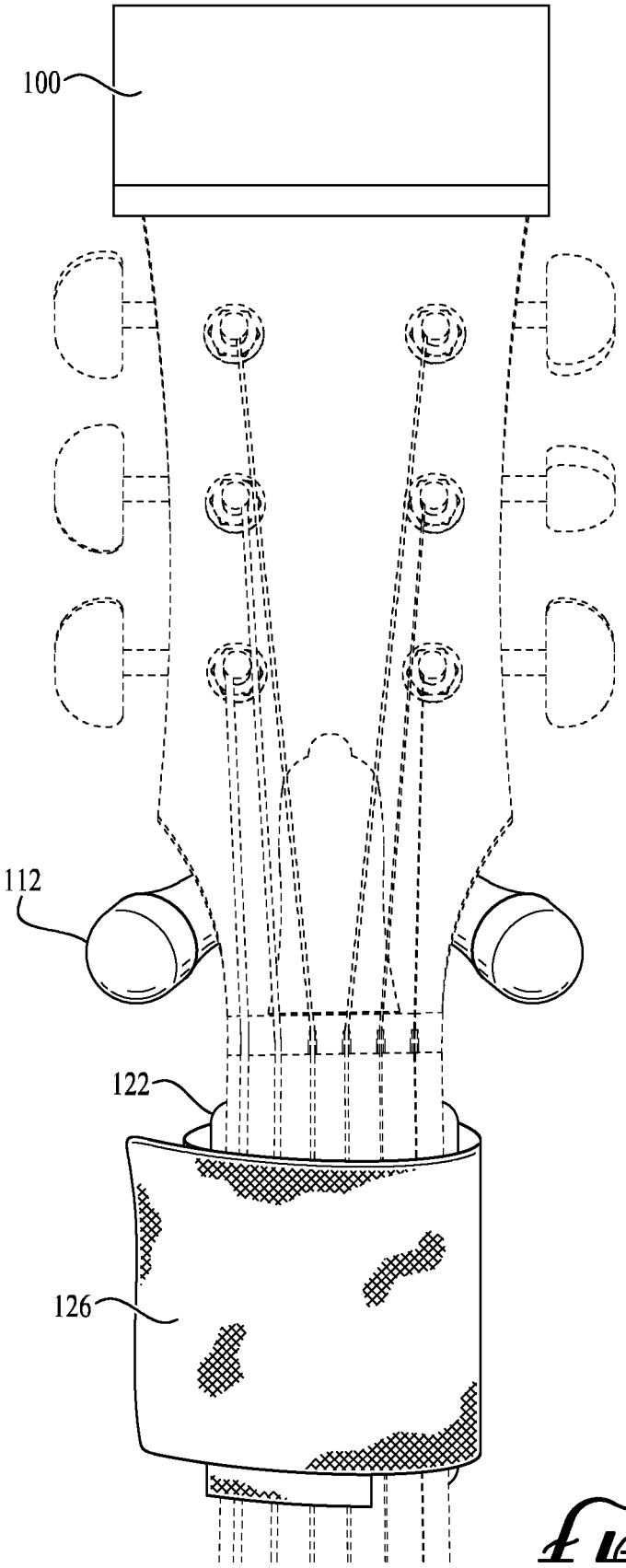
FIG. 6 is a front view of the present invention with subject guitar.
Figure 7:
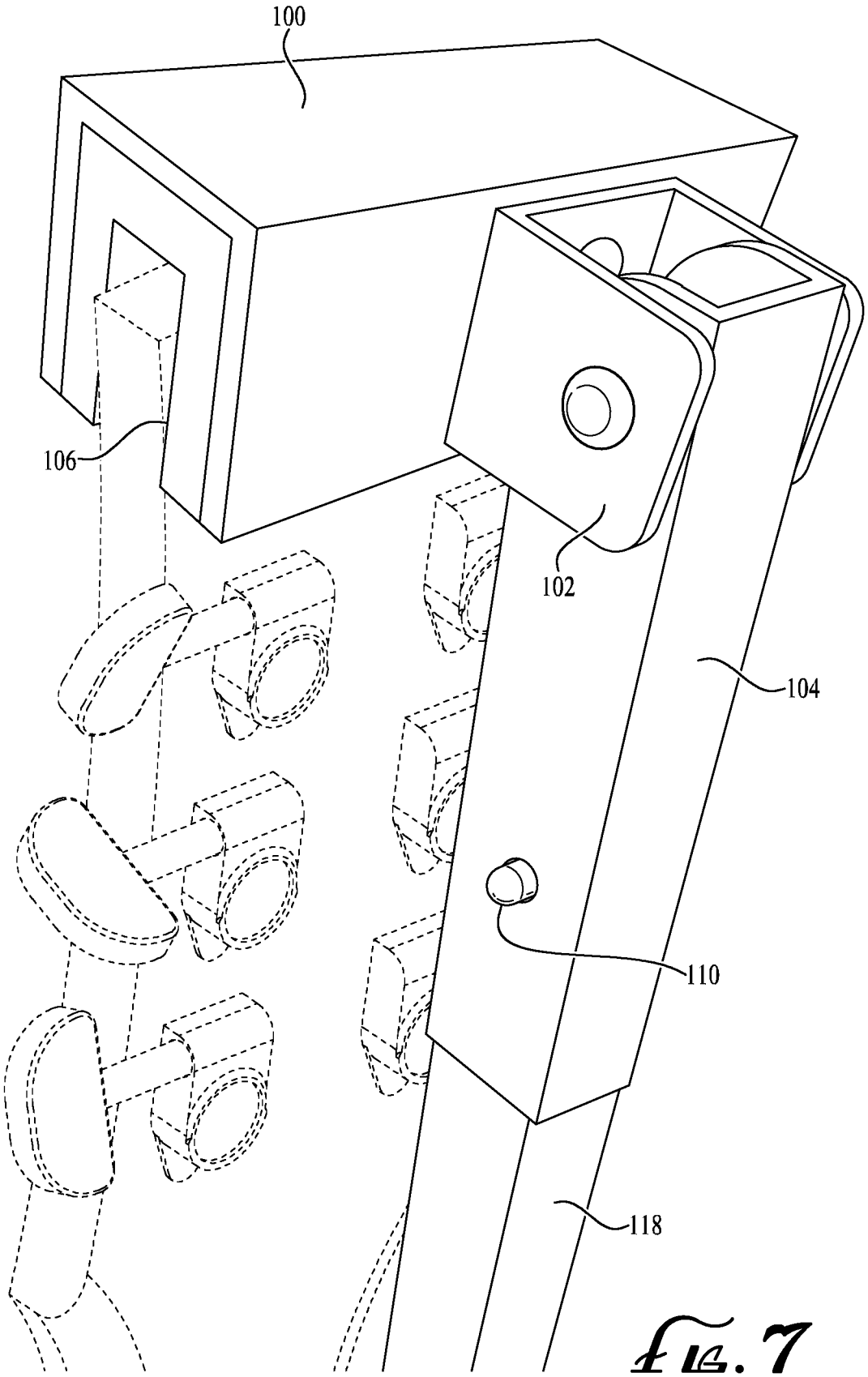
FIG. 7 is a partial upper rear view of the present invention from an angled position extending away from head vise with a partial view of guitar therewith.
Figure 8:
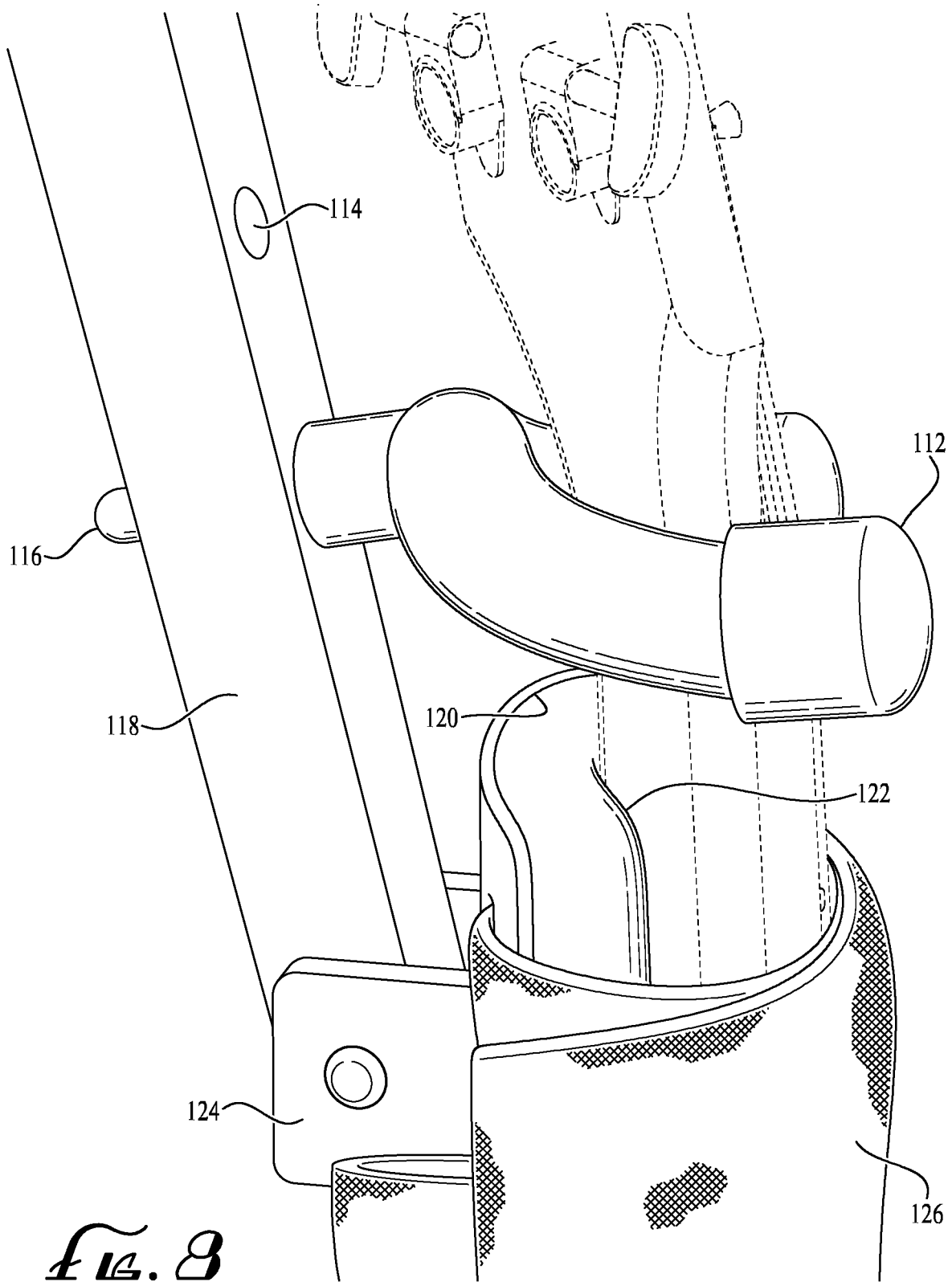
FIG. 8 is a close side view of the present invention with arm, neck stay and neck saddle.
Figure 9:
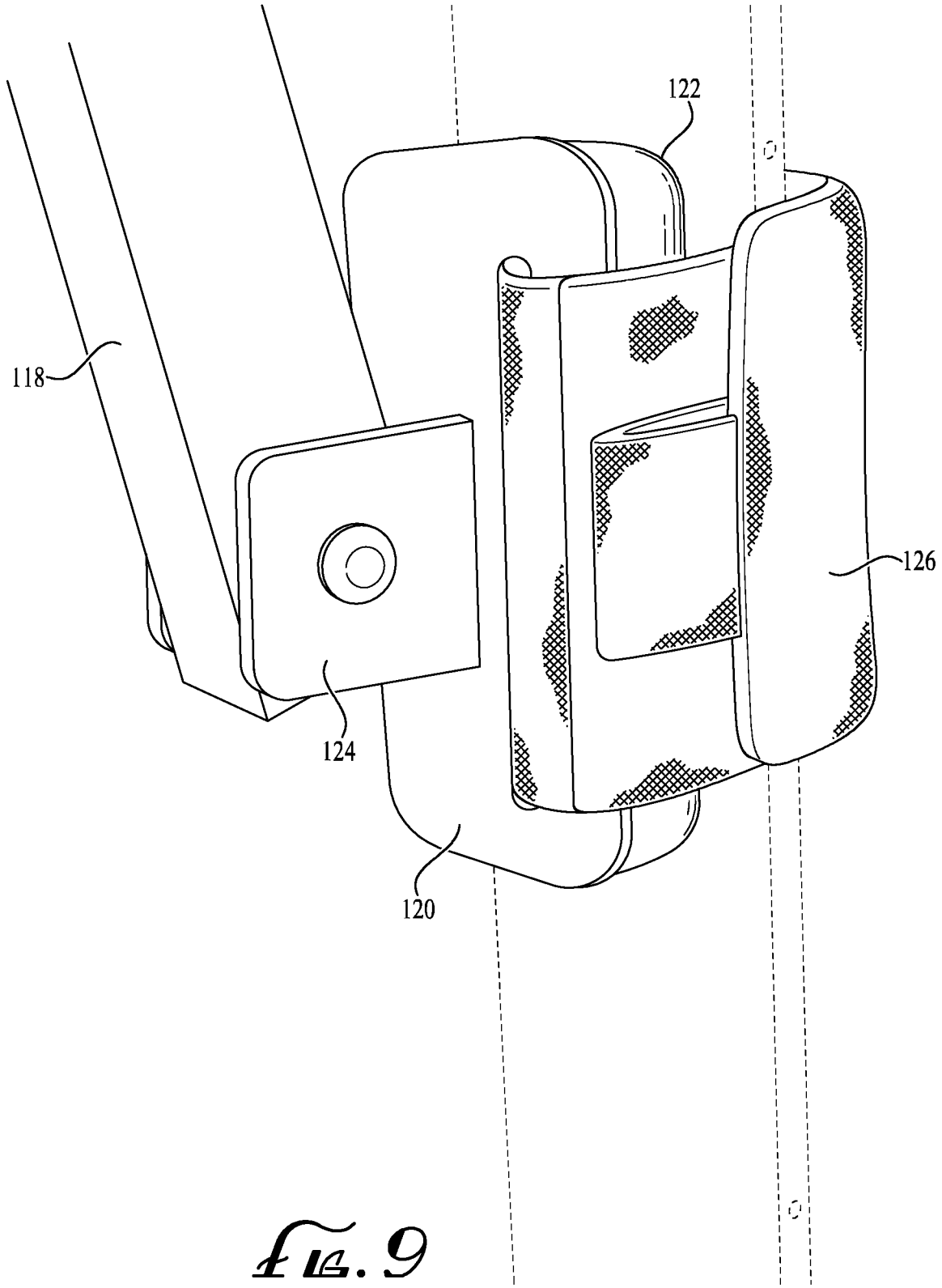
FIG. 9 is a close view of the present invention with subject guitar having neck strap attached across neck saddle with Velcro and tab on neck strap.
Figure 10:
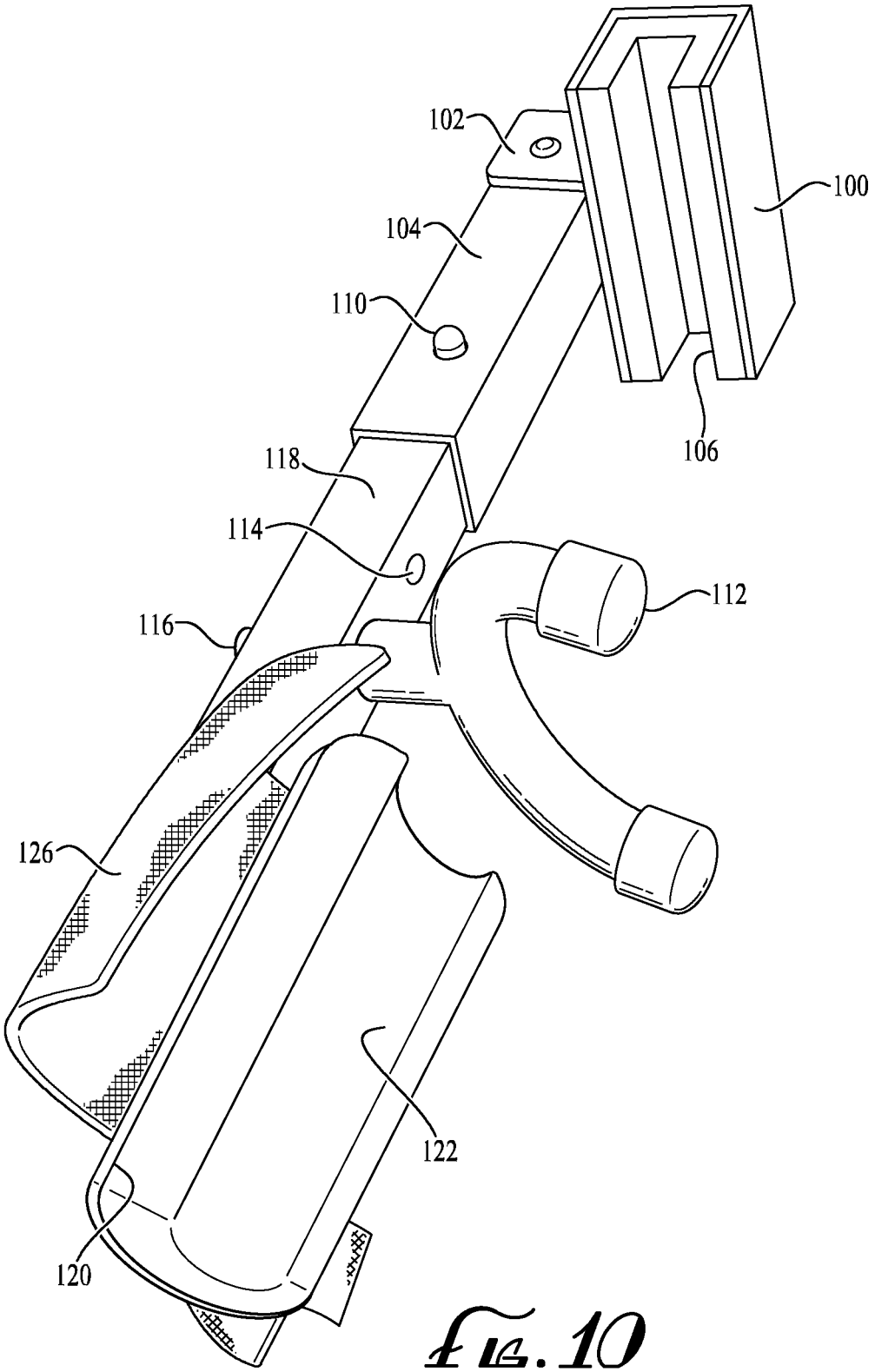
FIG. 10 is an overall angled view of the present invention with neck saddle and neck saddle pad in partially exploded view without subject guitar.
Figure 11:
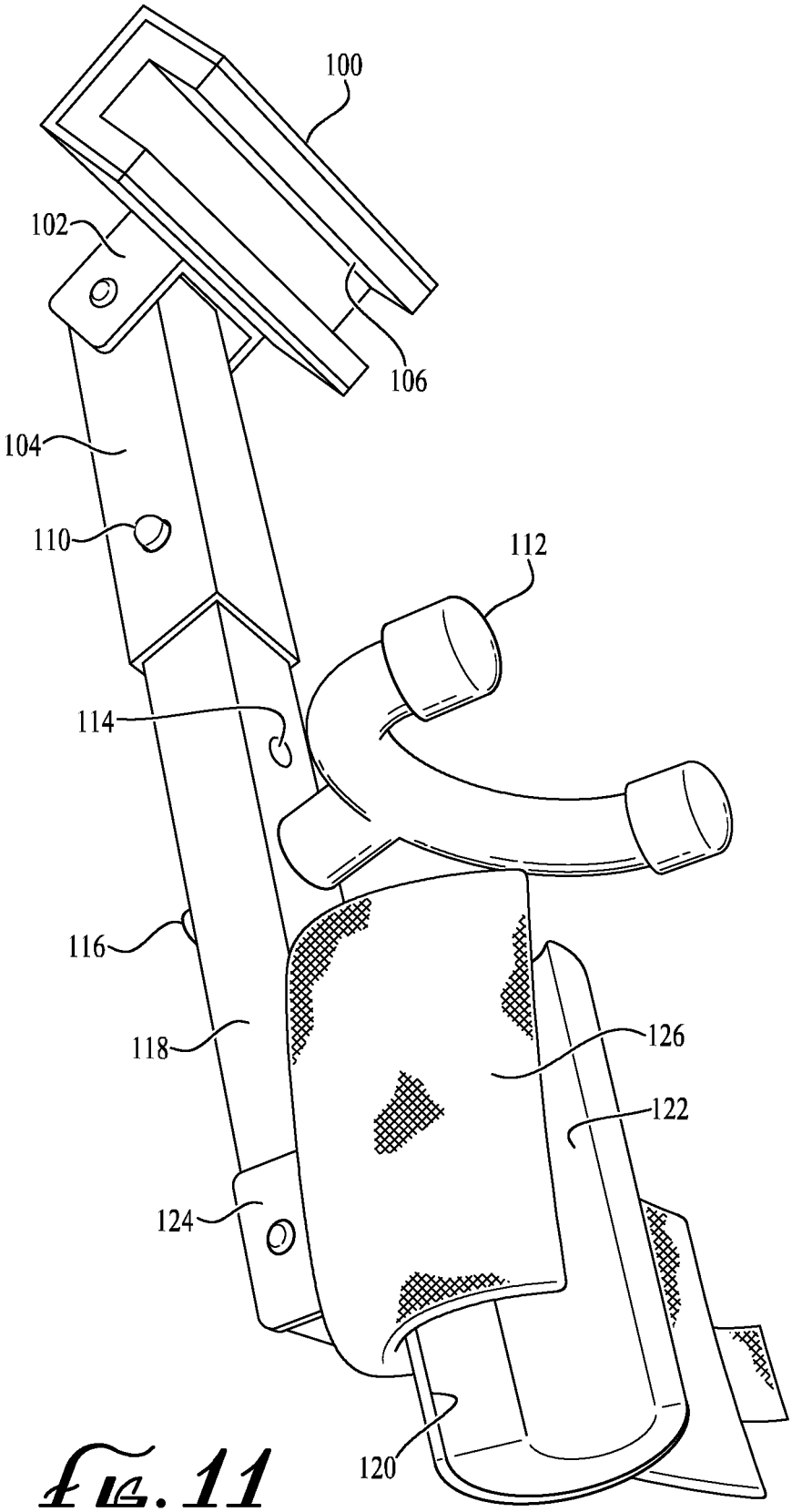
FIG. 11 is an overall angled view of the present invention with neck strap in open position.

This specification provides for specific meanings with respect to the present invention, the meanings of which shall be understood as follows:

Shown in FIGS. 1-11 are head vise 100, head vise bracket 102, arm sleeve 104, padded cushion 106, first arm sleeve hole 108, second arm sleeve hole 110, neck stay 112, first neck stay hole 114, second neck stay hole 116, arm 118, neck saddle 120, neck saddle pad 122, neck saddle bracket 124, and neck strap 126.

Head vise 100 can be a grip having an attaching portion preferably with padded cushion 106. Head vise 100 can be configured to grip the headstock of a guitar instrument. In a possible embodiment, head vise 100 can be connectable with arm 118 or arm sleeve 104 via head vise bracket 102. In an embodiment, arm 118 can be telescopically adjustable and can be locked at a preferred length via an interlocking spring-loaded pushpin. In other embodiments, head vise 100 can be provided as an angle for guitars having an angled or other-shaped head. A person having ordinary skill in the pertinent art would understand from the teachings of this specification that the present invention is not limited to using head vise only in top-down instruments. In lesser preferred but possible embodiments, head vise can have two surfaces enclosing a grip instead of three. In a possible embodiment, head vise can be preconfigured or adjusted to accommodate varying dimensions and angles for a given guitar. A person having ordinary skill in the pertinent art would understand from the teachings of this specification that a purpose of head vise 100 can be to avoid interference with tuning machines while gripping the head and working with neck saddle 120. A benefit of head vise 100 can be to provide a securing hold on subject guitar's head in a shape accommodating the form of subject guitar.

Head vise bracket 102 can be a rotatably movable about the plane of arm toward or away from neck stay 112 or neck saddle 120. Head vise bracket (102) can be connected to head vise 100 and at least one arm 118.

Arm sleeve 104 can be a rigid portion, metal, plastic, rubber, or other rigid interconnectable portion, tubular or otherwise telescopically adjustable with a sleeve portion such as arm sleeve 104.

Padded cushion 106 can be made of foam, sponge, textile, flexible rubber, or any other flexible material. There can be at least one padded cushion 106 on each of the inner sides of each of the opposing sides of the pair of opposing sides of head vise 100. Padded cushion 106 can line inner portions of head vise 100. In some preferred embodiments, padded cushion 106 can form a cushion suitable for the top of the head of a guitar instrument such that its position can avoid interfering with the position of tuning machines. A cloth can cover the outer form of foam and can provide a branded portion. A person having ordinary skill in the pertinent art would understand from the teachings of this specification how to apply padded cushion 106 and head vise 100 to appropriately and simultaneously cushion and hold the desired string tensioned guitar or other similar instrument. A benefit of padded cushion 106 can be to more precisely provide an appropriate fit of head vise 100 to the desired instrument head.

First arm sleeve hole 108 can be a radial cutout slightly greater in diameter than an outer diameter of a spring-loaded pushpin. A benefit of first arm sleeve hold 108 can be to selectably shorten or lengthen the overall length of arm 118. First arm sleeve hole 108 can be linear with second arm sleeve hole 110 or third arm sleeve hole 111 can be adjusted. A benefit of using pin-based embodiments can be to ruggedize the present invention and for fast interlocking use.

Neck stay 112 can be a stabilizing U-shaped extension such as a two-pronged U shape. Inside of the U of neck stay 112 can be cushioned by a foam coating around a tubular U. In an embodiment, neck stay 112 can be similar to a portion of a guitar neck holder and thereby can be intuitively matched by a user to position the neck onto the shape of the U. A benefit of neck stay 112 can be to further stabilize guitar. A further benefit of guitar neck stay can be to provide an intuitive interface for guitar neck to be placed thereon to facilitate the process of attaching the present invention to subject guitar.

First neck stay hole 114 can be a hole to fixably position neck stay 112. A benefit of first neck stay hole 114 can be to provide a first position to which neck stay 112 can be thereby positioned by intersecting an extending portion with neck stay 112 with first neck stay hole 115.

Second neck stay hole 116 can be positioned along arm between neck saddle 120 and head vise 100.

In some embodiments, stay holes such as 114 and 116 can promote locking positions instead of telescopic extensions of arm 118. Telescopic arm may be inferior to having neck stay holes because a moving arm can affect position of both neck saddle 120 and neck stay 112 whereas movable neck stay 112 via first neck stay hole 114 and second neck stay hole 116 can provide further configurability without moving neck saddle by elongating arm 118 as appropriate to fit a given guitar head and accommodating the length of a given guitar with tuning machines.

Arm 118 can be an elongated portion connecting neck saddle, neck stay, and head vise 100. Arm 118 can be any rigid material, preferably a lightweight metal such as aluminum or rigid plastic. A benefit of arm 118 can be to provide a fixed body to help reinforce against stress on the neck that can result in breakage. A benefit of arm 188 an extendable and retractable length with fixable positions to customize length to a given guitar size, thereby adjusting neck saddle 120, neck stay 112, and/or head vise 100. A benefit of arm 118 can be to position neck saddle or neck stay parallel to a guitar neck from head vise 100. A benefit of arm 118 as a lightweight material can be to provide rigidity alleviating stress from the guitar's neck thereby decreasing stress on the neck to decrease or eliminate chances of breakage during storage or transportation of subject guitar. Arm 118 can provide a length configured to be parallel to a guitar neck.

Neck saddle 120 can have a concave surface. A benefit of neck saddle can be to facilitate positioning subject guitar neck in preparation for neck strap 126 to wrap the subject guitar to be secured with neck saddle 120. Neck saddle 120 can be positioned distal from head vise 100 along arm 118. In some embodiments there can be neck saddle pad 122 to cushion neck saddle 120 against a given guitar. A benefit of embodiments with seat on neck saddle 120 can be to provide additional cushion while maintaining positioning of neck along with neck stay 112. Neck saddle 120 can have outer curvatures which can provide a benefit of acting to handle a subject guitar neck to maintain position and promote reinforcement.

Neck saddle pad 122 can be a padded portion on the concave surface of neck saddle 120 to provide cushioning. Neck saddle pad 122 can be affixed upon neck saddle 120. A benefit of neck saddle pad 122 can be to provide an extended portion along the neck of a subject guitar rather than being limited to the shape of neck saddle 120 alone. A benefit of neck saddle pad 122 can be to reduce direct stress at the location of neck saddle 120 relative to the subject guitar.

Neck saddle bracket 124 can be fixably attached to hold neck saddle 120 on arm 118, which can be distant from head vise 100. Neck saddle bracket 124 bracket can be positioned on arm 118 such that bracket 124 connects to arm on the convex side of neck saddle 120. Neck saddle bracket can be bracketed with arm 118 to fix a position of neck saddle 120 relative to head vise 100 and arm 118.

Neck strap 126 can be a band configured to strap across the length of the outer curvatures of neck saddle 120. Neck strap 126 can be textile or cushioned material to strap neck saddle bracket. In some embodiments, neck strap 126 can have a Velcro portion 128 (FIG. 11) or other material permitting neck trap 126 to hold subject guitar with neck saddle 120. Neck strap 126 can extend from neck saddle 120 across the neck saddle 120. A benefit of neck strap 126 can be to strap in the guitar to the saddle to reduce movement during transport; and to work in conjunction with head vise 100 and neck stay 112 thereby reinforcing the neck of subject guitar. Neck strap 126 can have a tab (FIG. 9) thereon facilitate releasing or attaching neck strap 126 thereby fastening or removing subject guitar from neck saddle 120 or neck saddle pad 122. A benefit of neck strap 126 can be to provide an easy and fast way to secure guitar to neck saddle 120. A person having ordinary skill in the pertinent art would understand from the teachings of the present invention how to make and use the neck strap 126 to hold subject guitar to neck saddle 120.

A person having ordinary skill in the pertinent art would understand from the teachings of the present specification how to make and use the present invention as applicable to any string-tuned instrument having adjustably tensions strings, neck and tuning capability. A person having ordinary skill in the pertinent art would understand from the teachings of this specification how to integrate the teachings of the present invention with a hard guitar case, gig bag, guitar stand, mount, display, rack, or container without departing from the scope of the present invention.

The present invention can be understood in light of the appended claims and are self-supported thereby. One of ordinary skill in the pertinent art would understand how to implement the claimed invention in light of the present specification.

The present invention can be understood to apply to equivalent variations of the foregoing elements and combinations thereof. The present invention applies to guitar instruments now known or later developed and any equivalents thereof.

CONCLUSION

In summary, the present invention provides a system and method for guitar neck reinforcement during transit is disclosed with a head vise (100); a head vise bracket (102); an arm sleeve (104); an at least one padded cushion (106); a first arm sleeve hole (108); a second arm sleeve hole (110); a neck stay (112); a first neck stay hole (114); a second neck stay hole (116); an at least one arm (118); a neck saddle (120); a neck saddle pad (122); a neck saddle bracket (124); and a neck strap (126). The foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A device for guitar neck reinforcement during transit, comprising: a head vise (100) having a pair of opposing sides formed thereon; and a head vise bracket.

2. The device of claim 1, wherein: the head vise bracket (102) is connected to an arm (118).

3. The device of claim 1, where the head vise (100) further comprises an at least one padded cushion (106).

4. The device of claim 2, wherein the arm (181) is connected to a neck saddle (120).

5. The device of claim 4, wherein the head vise (100) and the neck saddle (120) are connected to the arm (118) at different positions.

6. The device of claim 2, further comprising: a neck stay (112) forms a U-shape on the arm.

7. The device of claim 6, wherein the neck stay (112) is connected to the arm between the neck saddle (120) and the head vise (100).

8. The device of claim 2, further comprising: a first arm sleeve hole (108) is positioned along the arm to extend or retract from a second arm sleeve hole (110).

9. The device of claim 2, wherein the arm (118) comprises an arm sleeve (104) extendable and retractable to resize an overall length of the arm (118).

10. The device of claim 9, further comprising: a first neck stay hole (114) on the arm (118) wherein the neck stay (112) is positioned along the overall length of the arm (118) at the location of the first neck stay hole (114).

11. The device of claim 10, further comprising: a second neck stay hole (116) on the arm along the arm (118) other than at a position of the first neck stay hole (114).

12. The device of claim 4, wherein the neck saddle (120) is concave.

13. The device of claim 4, further comprising: a neck saddle pad (122) is affixed upon the neck saddle (120).

14. The device of claim 4, further comprising: a neck saddle bracket (124) connects the neck saddle to the arm (118).

15. The device of claim 1, further comprising: a neck strap (126) connected to the arm (118).

16. The device of claim 15, wherein the neck strap (126) is configured to a length suitable to be wrapped around the neck saddle (120).

17. The device of claim 16, wherein the neck strap (126) comprises Velcro material adhered to the surface of the neck strap (126).

18. The device of claim 17, further comprising: a tab is woven onto the neck strap (126).

19. The device of claim 18, further comprising: a neck saddle pad (122) adhered to the neck saddle (120).

20. A system for guitar neck reinforcement during transit, comprising:

(a) a head vise (100);

(b) a head vise bracket (102) connected to the head vise (100); and (c) an arm sleeve (104) connected to the head vise bracket (102).

* * * * *